US009032792B2

(12) United States Patent
Bradley et al.

(10) Patent No.: US 9,032,792 B2
(45) Date of Patent: May 19, 2015

(54) FOULING REDUCTION DEVICE AND METHOD

(75) Inventors: Michael E. Bradley, Shorewood, IL (US); Michael J. Murcia, DeKalb, IL (US); Daniel E. Schwarz, Naperville, IL (US); Mita Chattoraj, Warrenville, IL (US)

(73) Assignee: Nalco Company, Naperville, IL (US)

( * ) Notice: Subject to any disclaimer, the term of this patent is extended or adjusted under 35 U.S.C. 154(b) by 465 days.

(21) Appl. No.: 13/306,211

(22) Filed: Jan. 19, 2012

(65) Prior Publication Data

US 2013/0186188 A1 Jul. 25, 2013

(51) Int. Cl.
*B08B 3/12* (2006.01)
*B08B 7/02* (2006.01)

(52) U.S. Cl.
CPC .. *B08B 3/12* (2013.01); *B08B 7/028* (2013.01)

(58) Field of Classification Search
CPC ..... B08B 3/12; B08B 7/028; G10K 11/004; A47L 2601/17
USPC ..... 134/104.1
See application file for complete search history.

(56) References Cited

U.S. PATENT DOCUMENTS 3,479,873 A * 11/1969 Hermanns ..... 73/861.12
3,664,191 A * 5/1972 Hermanns ..... 73/861.12
4,216,671 A * 8/1980 Kurland ..... 73/61.72
4,385,936 A 5/1983 Rossi
5,416,581 A 5/1995 Kanngiesser
5,529,635 A 6/1996 Odell
5,889,209 A 3/1999 Piedrahita et al.
6,093,292 A * 7/2000 Akiyama ..... 204/263
6,369,894 B1 4/2002 Rasimas et al.
6,452,672 B1 9/2002 Trainoff
6,474,350 B1 * 11/2002 Mizuta ..... 134/56 R
6,572,709 B1 6/2003 Kaneda et al.
6,678,045 B2 * 1/2004 Rettig et al. ..... 356/338
6,681,783 B2 * 1/2004 Kawazoe ..... 134/169 C
6,886,406 B1 * 5/2005 Couet et al. ..... 73/579
6,977,015 B2 12/2005 Hardwicke et al.
7,250,302 B2 7/2007 Bernhardsson et al.
7,341,695 B1 3/2008 Garner
7,474,400 B2 * 1/2009 Tartakovsky et al. ..... 356/317
7,763,177 B2 7/2010 Rozenberg et al.
7,799,146 B2 9/2010 McLoughlin et al.
7,803,323 B2 9/2010 Cronin et al.

(Continued)

OTHER PUBLICATIONS

KIPO, International Search Report in International Patent Application No. PCT/US2012/065411, 3 pp., Mar. 19, 2013.

(Continued)

*Primary Examiner* — David A Rogers
(74) *Attorney, Agent, or Firm* — Leydig, Voit & Mayer, Ltd.

(57) ABSTRACT

A device and method for reducing and/or preventing fouling of a sensor is disclosed. The method comprises operating ultrasound technology that is submerged or partially submerged into a liquid medium that is responsible for the fouling. The device comprises the ultrasound technology itself. The ultrasound technology may be operated intermittently at high intensity to advantageously provide cavitation of the liquid medium, while avoiding the disadvantages typical of continuously operating ultrasound technology at high intensity. Additionally, the method may be carried out by taking advantage of the piezoelectric property of quartz.

12 Claims, 2 Drawing Sheets

(56) References Cited

U.S. PATENT DOCUMENTS

| | | | | |
|---|---|---|---|---|
| 7,804,598 | B2 * | 9/2010 | Hall et al. | 356/445 |
| 7,808,642 | B2 | 10/2010 | Connelly et al. | |
| 8,298,391 | B2 * | 10/2012 | Silveri | 204/416 |
| 8,545,682 | B2 * | 10/2013 | Jones et al. | 204/267 |
| 2002/0069893 | A1 * | 6/2002 | Kawazoe | 134/1 |
| 2002/0162582 | A1 * | 11/2002 | Chu et al. | 134/105 |
| 2005/0210983 | A1 | 9/2005 | Klein et al. | |
| 2006/0084891 | A1 | 4/2006 | Barthe et al. | |
| 2008/0196853 | A1 * | 8/2008 | Rice | 162/181.3 |
| 2009/0014329 | A1 * | 1/2009 | Silveri | 204/412 |
| 2009/0145202 | A1 * | 6/2009 | Tokhtuev et al. | 73/61.48 |
| 2012/0060873 | A1 * | 3/2012 | Akutsu | 134/184 |
| 2012/0195994 | A1 * | 8/2012 | El-Siblani et al. | 425/174.4 |
| 2012/0255361 | A1 * | 10/2012 | Thabeth et al. | 73/655 |

OTHER PUBLICATIONS

KIPO, Written Opinion in International Patent Application No. PCT/US2012/065411, 5 pp., Mar. 19, 2013.

* cited by examiner

FOULING REDUCTION DEVICE AND METHOD

FIELD OF THE INVENTION

The invention is related to a device and method of reducing or preventing fouling in a sensor. More specifically, the invention is related to a device and method of reducing or preventing fouling by emitting ultrasonic waves into a liquid medium that passes through or past a sensor.

BACKGROUND

Sensors, such as the Nalco 3D fluorometer, are useful instruments for measuring water quality and controlling industrial water treatment systems. Fouling of the sensor due to contaminants in water, however, is a well-known problem. When the fouling potential of the water is great enough, sensors foul so quickly and often that they can become practically useless. An example of a type of water with great fouling potential is wastewater. Depending on the configuration of the sensor, different mechanical approaches have been used to reduce and/or eliminate fouling on critical areas of the sensor.

A variety of sensor designs employing mechanical fouling prevention techniques are known in the art. For example, "probe" style sensors where the measuring system is exposed to the water at one flat end of the probe are often equipped with a rubber wiper designed to wipe away foulants from the face of the probe. Examples of such devices are illustrated in U.S. Pat. Nos. 5,416,581 and 7,341,695. The wiper operates intermittently and must be replaced on occasion. In addition, the motor inside the probe that drives the wiper may fail from time to time, and the seal separating the electronics from the liquid medium can also be a point of failure. Even during normal operation, the presence of a wiper mechanism on an otherwise flat faced probe can provide an attachment point for foulants to begin depositing on the probe.

As illustrated in U.S. Pat. No. 6,678,045, probe-style sensors have also been equipped with ultrasonic transducers designed to vibrate the optical sensor at a certain frequency, or over a range of frequencies. Similar approaches employing ultrasound have been applied to vibrate an instrument with a glass cuvette for optical measurements of a flowing water stream (e.g., U.S. Pat. No. 7,808,642), an optical flow cell (e.g., U.S. Pat. No. 6,452,672), an ultraviolet disinfection system (e.g., U.S. Pat. No. 7,763,177), a steam generator (e.g., U.S. Pat. No. 6,572,709), and fluid filled tubes with closed ends (e.g., U.S. Pat. No. 5,529,635). In these examples, the devices that transmit ultrasound make contact with a solid surface of the sensor and are constantly powered. To prevent breakage of the sensor, these applications employ low power and low intensity ultrasound, which has been found ineffective for preventing or removing fouling of sensors. Further, ultrasound has been applied to clean interior surfaces (see U.S. Pat. Nos. 7,799,146; 5,889,209; 6,977,015).

Other mechanical devices for preventing or removing foulants on sensors exist. For example, pressurized air or water (e.g., U.S. Pat. No. 7,250,302), or pressurized process fluids (e.g., U.S. Pat. Nos. 7,803,323 and 4,385,936) in the form of a jet are intermittently sprayed at the critical area of the sensor surface to remove foulants.

Accordingly, there is a need for a device and/or method for preventing removing fouling of sensors. Desirably, the device and/or method would be effective for use in even the most contaminated fluid. More desirably, the device and/or method would employ high intensity ultrasonic technology without the need for operator intervention.

SUMMARY OF THE INVENTION

The invention is directed toward a method of reducing and/or preventing fouling of an sensor that is operably attached to an apparatus. The sensor measures at least one parameter within a liquid medium of the apparatus. The method comprises the steps of providing an ultrasound technology comprising a transducer and a probe, wherein the probe and the transducer are operably connected to each other so that the transducer receives a signal from a source, translates the signal to mechanical energy, and transfers the mechanical energy to the probe; submerging at least a portion of the probe into the liquid medium; and operating the ultrasound technology by sending the signal to the transducer so that the probe transfers cyclic sound pressure waves into the liquid medium causing cavitation within the liquid medium, the cavitation sufficient to at least reduce fouling of the sensor.

Alternately, the invention is directed toward a method of reducing and/or preventing fouling of an optical sensor. The optical sensor is comprised of a quartz flow cell. The method comprises the steps of providing the optical sensor that measures at least one parameter within a liquid medium; operably equipping the optical sensor with an electrical source; and applying the current to the quartz flow cell with opposing polarity, the current causing the quartz flow cell to resonate, the resonation causing cavitation within the liquid medium, the cavitation sufficient to at least reduce fouling of the quartz flow cell.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
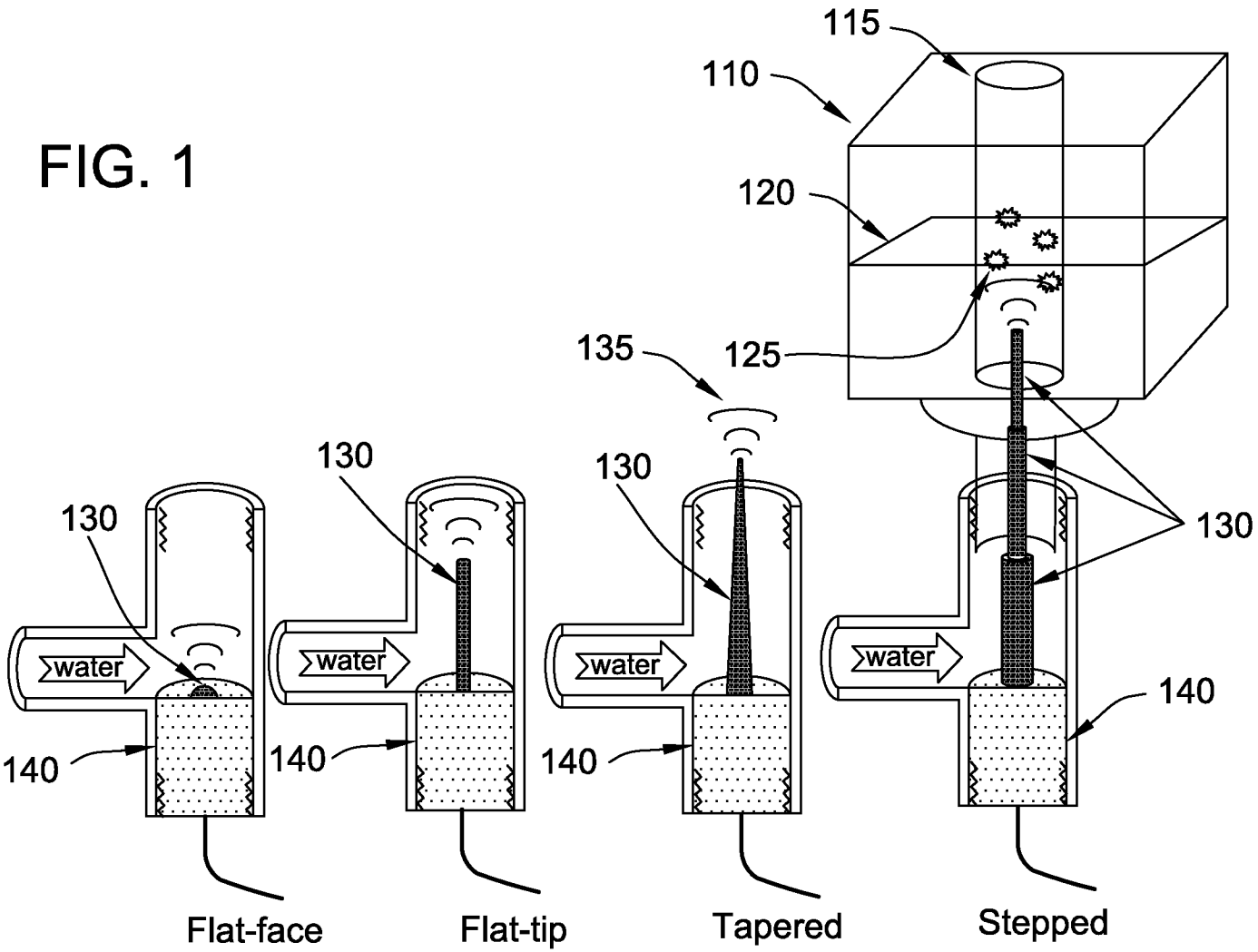
FIG. 1 illustrates several embodiments of the invention and one application illustrating the invention in operation.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description of the Invention," relates to a requirement of the United States Patent Office, and does not imply, nor should be inferred to limit the subject matter disclosed herein.

A new system and method to reduce and/or prevent fouling, and/or clean fouled sensors, such as a Nalco 3D fluorometer, is disclosed. The invention incorporates the use of ultrasonic technology over prior cleaning devices. The invention provides a mechanical solution that at least reduces the occurrence of sensor fouling.

In a presently preferred embodiment, ultrasonic waves are emitted into a liquid medium that flows through or past the sensor. The term "sensor" should be broadly construed to include an optical sensor and also transparent or translucent sensor housings and such. In particular, the term "sensor" includes, but is not limited to, a fluorometer, an infrared sensor, an ultraviolet sensor, a flow cell, a pH sensor, an ORP sensor, a temperature sensor, and any similar technology.

An important advantage of applying ultrasonic waves to the liquid phase instead of the solid phase is the phenomenon of cavitation, or the creation of small imploding "bubbles" in the liquid phase due to the oscillating ultrasonic sound waves. The imploding bubbles produce high energy forces of heat and flow that are sufficient to clean the surrounding surfaces. Intense cavitation can be accomplished through the use of ultrasonic transducers and probes that are designed to be immersed, either completely or partially, into a liquid medium.

Several examples of embodiments of the invention are shown in FIG. 1, where the height and form of the ultrasonic probe are varied. Note that, in addition to the bottom mount configuration shown in FIG. 1, top mounting is also anticipated.

Another advantage of the present invention is that the invention can be easily retro-fitted onto existing instruments with little effort. Since the entire ultrasound device is functionally and physically separate from the sensor, an instrument that is already installed in the field can be retro-fitted with the ultrasonic technology. However, a sensor or an apparatus could be initially manufactured to be equipped with ultrasonic technology as disclosed.

Another improvement relates to the operation of the ultrasonic technology. Whereas previous designs have operated continuously at low intensity, the present invention is designed to operate intermittently at relatively high intensity. While high intensity ultrasonic technology is most effective at cleaning, such operation has disadvantages. For example, high intensity ultrasonic technology can create disturbances in the liquid medium that interfere with the sensor measurements. Additionally, the ultrasonic technology device can erode over time. The term "high intensity" should be construed to include intensities greater than one watt per square millimeter at the tip of the ultrasonic probe. The power intensity applied to the ultrasonic probe is directly related to the amplitude of movement at the tip of the probe, with greater amplitudes producing greater amounts of cavitation.

In order to minimize the disadvantages while preserving the benefits of high intensity ultrasound, the exact timing, frequency, and power applied by the ultrasonic technology can be varied to meet the demands of the particular application. Further the ultrasonic technology can be triggered to turn on when the sensor readings indicate that a lower limit of fouling has occurred on a critical area of the sensor.

As a result of the intermittent operation, measurements can operate without interference from the effects of the ultrasound during the periods when the ultrasonic technology is not operating. In addition, the use of high intensity ultrasound for short periods can provide more intensive cleaning action on the sensor. In a typical application, the ultrasonic technology may be operated for no more than 5% of the time of operation of the sensor.

To maximize the cleaning efficiency of the instant invention, the ultrasound technology should be submerged into the liquid medium in a manner such that the emitted sound waves are not opposing the direction in which the liquid medium may be flowing. Acceptable orientations include those in which the sound waves and liquid flow vectors are parallel (but not opposing), perpendicular, or any angle other than 180 degrees. In addition, it may be beneficial to combine the ultrasound technology with turbulent flow in the vicinity of the probe tip to increase the effectiveness of the cavitation. Such turbulent flow can be introduced through the use of baffles, static mixers, or other devices known to those skilled in the art, It may also be beneficial to combine the ultrasound technology with chemical cleaners when ultrasound or chemical cleaning alone is insufficient. Such chemical cleaners can be metered into the liquid medium at a time corresponding to the intermittent operation of the ultrasound technology.

In the embodiments illustrated in FIG. 1, a transducer (140) is connected to a probe (130) that is at least partially submerged into a liquid medium flowing through a quartz flow cell (115) inside an apparatus (110). The apparatus (110) may be a fluorometer housing. Ultrasonic waves (135) are produced inside the liquid media that is within the quartz flow cell (115) by the transducer (140) and transmitted to the probe (130), passing into the liquid media within the quartz flow cell (115). The ultrasonic waves (135) should be sufficient to induce cavitiation (125), either constantly or intermittently, within the liquid medium. The plane of measurement (120) is demonstrated for a typical embodiment. For this and all embodiments, a signal is sent to the transducer (140) from a source (not shown) via a conducting wire (shown but not numbered) or any appropriate conducting means.

The cavitation (125) reduces and/or prevents the deposition of foulants and/or removes foulants that were already deposited. The transducer (140) can be any design known to those skilled in the art of ultrasonic technology, such as those described in U.S. Pat. No. 7,763,177 to Rozenberg et al. Preferably, the transducer should be a composite material that exhibits piezoelectric effect and outputs in a range of 20 to 200 kHz. More preferably, the output is in the range of about 40 to about 80 kHz, and most preferably the output is 40 kHz. A preferred composite material is lead zirconate.

The invention may be equipped with one or more nozzles for spraying compressed air, water, process fluid, or chemical cleaners onto critical areas of the sensor. The invention may additionally or alternately be equipped with a retractable brush or wiper for scraping debris from the interior walls of the flow cell. These non-ultrasonic devices can be either separate from the optical sensor or designed for incorporation at the time the sensor is manufactured.

Figure 2:
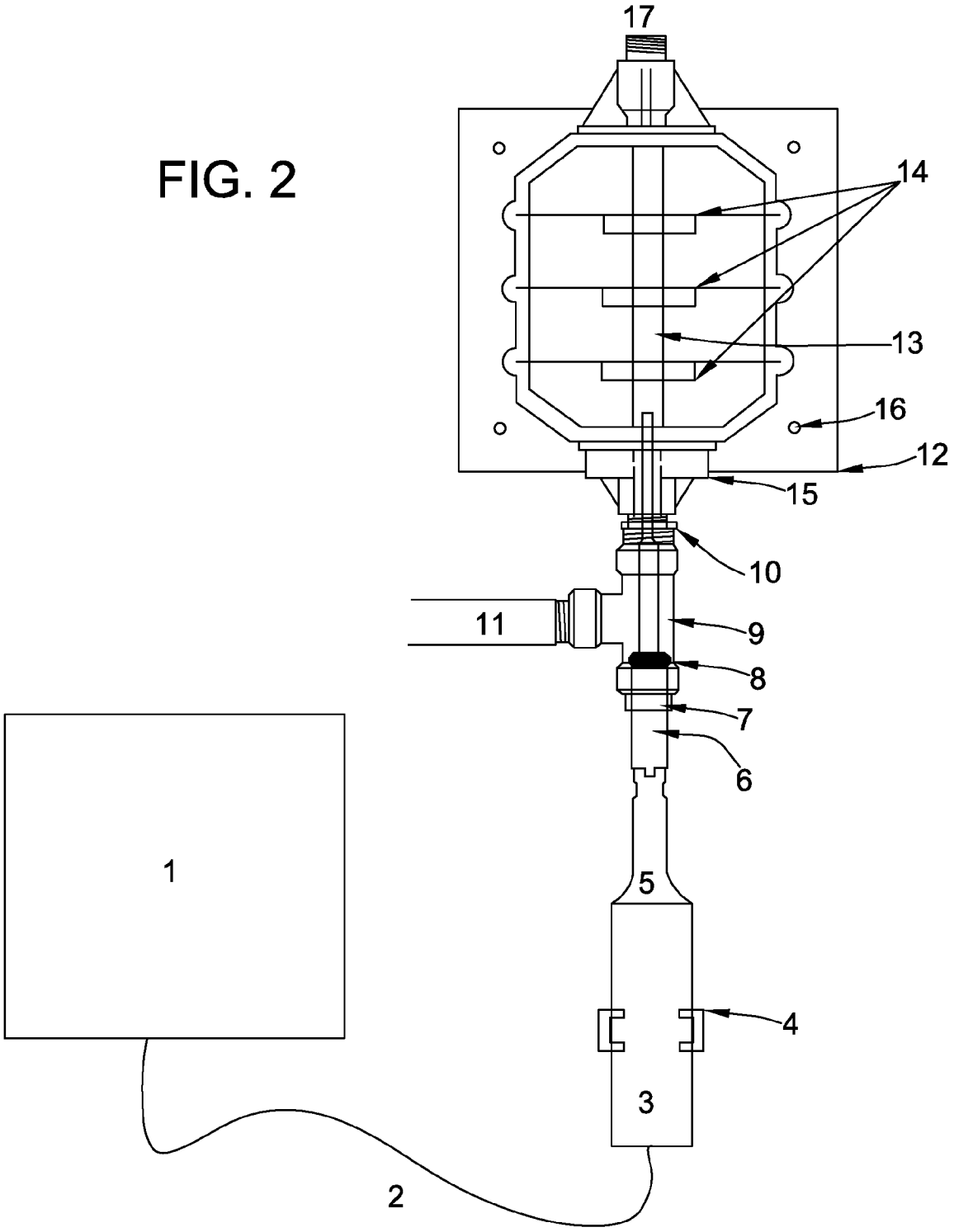
FIG. 2 illustrates a schematic of a typical embodiment of the invention.

FIG. 2 illustrates a typical embodiment of ultrasound technology (4) mounted in a process. An apparatus (12) is mounted (16) so that a liquid medium (11) passes through an inlet (15), through a flow cell (13), and through an outlet (17). The apparatus (12) comprises at least one sensor (14).

The liquid medium (11) in the process stream passes into a tee (9) and through and adaptor (10), which allows the ultrasound technology (4) to be mounted to the apparatus (12) so that the probe (6) penetrates into the liquid medium (11).

The ultrasound technology (4) comprises a transducer (3), a horn (5), and a probe (6). The probe (6) is comprised of at least one nodal point (8), and the probe (6) should be mounted to the apparatus (12) at the at least one nodal point (8) via a compression fitting (7). The ultrasound technology (4) may be connected to a source (1) by a communicating cable (2), or any other means of sending a signal from a source to a transducer (3). The source (1) may be an ultrasonic power supply that sends the signal to the transducer (3). The ultrasonic power supply may automatically control the amplitude and/or frequency of the signal, which in turn may control the amplitude and/or frequency of the emitted ultrasonic waves.

In an embodiment, the probe comprises a titanium alloy.

In another embodiment, the natural piezoelectric properties of quartz are used to produce vibrations without the use of a separate transducer. In this embodiment, electric current is applied with opposing polarity to a quartz flow cell. Preferably, the current is driven by an ultrasonic circuit board designed to output the current while sweeping through a range of frequencies. The action of sweeping through the range of frequencies reduces and/or prevents the formation of standing waves that can damage the contacted surfaces. The current may be applied intermittently.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the illustrated specific embodiments or examples is intended or should be inferred. The disclosure is intended to cover by the appended claims all such modifications as fall within the scope of the claims.

We claim:

1. A method of reducing and/or preventing fouling of a sensor operably attached to an apparatus, the sensor measuring at least one parameter within a liquid medium of the apparatus, the method comprising:

providing an ultrasound technology comprising a transducer and a probe, wherein the probe is located upstream of the sensor, and wherein the probe and the transducer are operably connected to each other so that the transducer receives a signal from a source, translates the signal to mechanical energy, and transfers the mechanical energy to the probe;

submerging at least a portion of the probe into the liquid medium; and operating the ultrasound technology by sending the signal to the transducer so that the probe ultrasonically vibrates upstream of the sensor causing cavitation in the liquid medium downstream of the probe, wherein the cavitation provides a reduction and/or prevention of fouling of the sensor.

2. The method of claim 1, wherein the operating is performed intermittently.

3. The method of claim 1, wherein the ultrasound technology is operated for no more than 5% of the time of operation of the sensor.

4. The method of claim 1, wherein the ultrasound technology is operated at a frequency greater than 20 kHz.

5. The method of claim 1, wherein the ultrasound technology is operated at a frequency of from about 20 kHz to about 200 kHz.

6. The method of claim 1, wherein the ultrasound technology is operated at a frequency of about 40 kHz.

7. The method of claim 1, wherein the sensor comprises a quartz flow cell.

8. The method of claim 1, wherein the transducer comprises a composite material.

9. The method of claim 8, wherein the composite material comprises lead zirconate.

10. The method of claim 9, wherein the probe comprises at least one nodal point, the probe operably mounted to the apparatus at the at least one nodal point.

11. The method of claim 10, wherein the probe comprises a titanium alloy.

12. The method of claim 1, wherein the ultrasound technology comprises an ultrasonic power supply sending the signal to the transducer and automatically controlling the amplitude and/or frequency of the signal, which in turn controls the amplitude and/or frequency of the emitted ultrasonic waves.

* * * * *